US005960711A

United States Patent [19]

Nordin

[11] Patent Number: 5,960,711

[45] Date of Patent: Oct. 5, 1999

[54] SCREW COMPRESSOR AND OUTLET PORTION FOR SCREW COMPRESSOR

[75] Inventor: Ulf Nordin, Mazurkavaägen 4, SE-663 02 Hammarö, Sweden

[73] Assignees: Ulf Nordin; Lennart Borjesson; Roland Erikkson, all of Hammaro, Sweden

[21] Appl. No.: 08/913,875

[22] PCT Filed: Mar. 11, 1996

[86] PCT No.: PCT/SE96/00313

§ 371 Date: Sep. 24, 1997

§ 102(e) Date: Sep. 24, 1997

[87] PCT Pub. No.: WO96/30198

PCT Pub. Date: Oct. 3, 1996

[30] Foreign Application Priority Data

Mar. 29, 1995 [SE] Sweden ..... 9501118

[51] Int. Cl.[6] ..... B30B 9/14

[52] U.S. Cl. ..... 100/127; 100/145; 100/147

[58] Field of Search ..... 100/117, 127, 100/129, 145, 147, 148

[56] References Cited

U.S. PATENT DOCUMENTS

| | | | |
|---|---|---|---|
| 332,718 | 12/1885 | Lafferty | 100/145 |
| 780,415 | 1/1905 | Eavenson | 100/148 |
| 1,750,764 | 3/1930 | Schaefer | 100/145 |
| 1,851,191 | 3/1932 | Lang | 100/148 |
| 2,055,263 | 9/1936 | Robinson et al. | 100/37 |
| 2,157,161 | 5/1939 | Carlson . | |
| 2,386,052 | 10/1945 | Lundy | 100/106 |
| 2,609,744 | 9/1952 | Rietz | 100/148 |
| 3,044,391 | 7/1962 | Pellett . | |
| 3,054,343 | 9/1962 | Pellett . | |
| 3,400,654 | 9/1968 | Vincent . | |
| 3,943,033 | 3/1976 | Wallén | 100/147 |

FOREIGN PATENT DOCUMENTS

| | | | |
|---|---|---|---|
| 230563 | 12/1985 | Germany | 100/129 |

*Primary Examiner*—Stephen F. Gerrity
*Attorney, Agent, or Firm*—Kilpatrick Stockton LLP

[57] ABSTRACT

The invention relates to a conical screw press for compressing and for removing liquid from bulk material, comprising a screw with a screw thread and a core in a housing, structure for rotating the screw in the housing, an inlet opening for the bulk material from which liquid is to be removed, an outlet opening for the bulk material from which liquid has been removed, and at least one outlet opening for the liquid which has been extracted. The characteristic features of the invention are that: a) the screw is dimensioned, for at least the greater portion of the length of the screw between the inlet opening for bulk material and the outlet opening for bulk material, such that the external diameter (D) of the screw thread and the diameter (d) of the screw core change axially in the screw press from a first axial position, where the external diameter of the screw thread=$D_1$ and the diameter of the screw core=$d_1$, to a second axial position, situated downstream in the direction of the bulk material, where the external diameter of the screw thread=$D_2$ and the diameter of the screw core=$d_2$, in accordance with the formula:

$$D_2 = \frac{D_1}{\sqrt[n]{K}} \qquad d_2 = \frac{d_1}{\sqrt[n]{K}}$$

where K is a compression ratio describing the volume of the bulk material at the first position in relation to the volume of the bulk material at the second position, and n is a number between 2.5 and 3.5; and b) the angle α of the screw threads in relation to a plane at right angles to the screw shank varies by at most 20% in either direction from a constant angle in relation to the plane within the portion of the length of the screw.

19 Claims, 2 Drawing Sheets

SCREW COMPRESSOR AND OUTLET PORTION FOR SCREW COMPRESSOR

TECHNICAL FIELD

The invention relates to a conical screw press for compressing and/or removing liquid from bulk material, comprising a screw with screw threads and core in a housing, means for rotating the screw in the housing, an inlet opening for the bulk material which is to be compressed and/or from which liquid is to be removed, an outlet opening for this bulk material, and, where appropriate, at least one outlet opening for the liquid which has been extracted.

BACKGROUND TO THE INVENTION

Screw compressors (screw presses) are used in particular for compressing and/or for pressing liquids out of various bulk materials. The object of this can be, for example, to compress bulk material, for instance to compress waste matter, such as textile waste or paper waste, for the purpose of reducing the volume thereof, to extract liquid from bulk material, for instance to extract oil from oil-containing plant material, or to concentrate bulk material, for instance to press liquid out of material, such as water out of wet bark, where the pressed bark has a higher dry matter content after pressing than it did before pressing, and consequently a higher thermal value on combustion, for heat production for example. The object can also be to use the screw compressor on its own, or the screw compressor included in a system with further devices and/or further screw compressors, to wash the bulk material by means of (repeated) sequential supply of "purer" liquid to the bulk material and removal of the liquid from the bulk material The internal friction in many bulk materials and the friction between the bulk material and the surfaces of the screw compressor result in an uneven compression of, and/or removal of liquid from, the bulk material in existing screw compressors where the reduction in the volume of the bulk material does not take place in a uniform manner, since, as a result of the internal friction in the bulk material which is being pressed, liquid in the first instance leaves that (surface) area of the bulk material which is exposed to the greatest compressing movement, which results, inter alia, in a low yield of liquid and a low dry matter content of the bulk material and/or entails a high energy consumption. Inappropriate dimensions and designs of conical screw compressors in the prior art also result in a remixing and breaking up of the material inside the screw compressor, which increases the energy consumption and can have a negative effect on the bulk material.

Screw compressors for removal of liquid need to be provided with some form of resistance means for the bulk material at the outlet opening for bulk material in order to prevent re-expansion of compressed bulk material while it is still in contact with the liquid which has been pressed out, which would result in rewetting of the bulk material. Conventional screw compressors therefore have adjustable resistance means such as, for example, flaps which are folded in towards the outlet, or they have resistance means which are mounted on the screw shank and are adjusted towards the outlet by hydraulics. These constructions are delicate, often give rise to leakage of liquid during removal of the liquid, and mean that the screw often has to be mounted at both the inlet end for bulk material and at the outlet end for bulk material.

BRIEF DESCRIPTION OF THE INVENTION

The object of the invention is to make available a conical screw compressor for efficiently and uniformly compressing and/or for removing liquid from bulk material. The conical screw compressor according to the present invention is in this case designed in such a way that the compression of the bulk material which is to be compressed and/or from which liquid is to be removed takes place linearly and uniformly as the bulk material is conveyed through the screw compressor, i.e. the volume inside the conical portion of the screw compressor decreases by essentially the same factor per unit length along the entire length of the conical portion of the screw compressor, and the compression of a unit volume in the screw is essentially of the same magnitude in all four directions, i.e. from the core of the screw towards the centre of the unit volume, from the inner side of the housing towards the centre of the unit volume, and from the screw threads on both sides of the unit volume towards the centre of the unit volume, so that the shape of the bulk material inside the conical portion of the screw press can be likened to a spiralled square rod with all four sides narrowing to the same extent towards the outlet opening for the bulk material.

This is achieved by virtue of the fact that the screw is dimensioned, within at least the greater portion of the length of the screw between the inlet opening for bulk material and the outlet opening for bulk material, such that the external diameter (D) of the screw thread and the diameter (d) of the screw core change axially in the screw compressor from a first arbitrary axial position, where the external diameter of the screw thread=$D_1$ and the diameter of the screw core=$d_1$, to an arbitrary second axial position, situated downstream in the direction of the bulk material, where the external diameter of the screw thread=$D_2$ and the diameter of the screw core=$d_2$, in accordance with the formulae:

$$D_2 = \frac{D_1}{\sqrt[n]{K}} \qquad d_2 = \frac{d_1}{\sqrt[n]{K}}$$

where K is a compression ratio, i.e. the volume of the bulk material at the first position in relation to the volume of the bulk material at the second position, and n is a number between 2.5 and 3.5, preferably between 2.7 and 3.3, expediently between 2.9 and 3.1. In the ideal case, n=3.

Some other features of the design of the screw threads can also change with essentially the same ratio as the screw thread, such as, for example, the width of the screw crests at the periphery b, and the thread root diameter R at the point of attachment of the screw crests to the screw core on that side which faces the bulk material inlet, in accordance with the formulae:

$$b_2 = \frac{b_1}{\sqrt[n]{K}} \qquad R_2 = \frac{R_1}{\sqrt[n]{K}}$$

where $b_1$ is the width of the screw crest and $R_1$ is the thread root diameter at the said first position, $b_2$ is the width of the screw crest and $R_2$ is the thread root diameter at the said second position, and n is the abovementioned number between 2.5 and 3.5, preferably between 2.7 and 3.3, expediently between 2.9 and 3.1, and ideally 3.

The angle ($\alpha$) of the screw threads in relation to a plane at right angles to the screw shank will preferably be constant, but it can vary by at most 20% in either direction from a constant angle in relation to the said plane within the said portion of the length of the screw, expediently by at most 10%, and preferably by at most 5%.

The compression ratio K calculated from the start of the conical screw to the end thereof depends, among other things, on the bulk material which is to be compressed. In the case of light, fluffy material, a high compression degree K of between 7 and 15, preferably of between 8 and 12, is chosen, while in the case of removing liquid from heavier material, for example sediment from a cellulose industry, a lower compression degree K of between 2 and 6, preferably of between 3 and 5, is chosen. Depending on the nature of the material and on the object of the pressing operation, K can assume any value between those mentioned above, and in extreme cases can even assume greater or lesser values than those mentioned above.

In the case of light and fluffy material, a relatively large ratio D:d is chosen, approximately 1.5 to 2.5, and a relatively small pitch angle $\alpha$ ($\alpha$ is the angle between the screw crest and a plane at right angles to the screw shank) of approximately 10° to 25°, whereas, in the case of removing liquid from cellulose sediment for example, D:d can be chosen to be 1.2 to 1.5 and $\alpha$ to be approximately 20° to 30°.

With the above design of the screw, very good results have been obtained, in terms of capacity and energy consumption, when compressing and removing liquid, compared to conventional conical screw compressors. The low energy consumption is due, inter alia, to the uniform compression, which also results in an even removal of liquid from the material in the screw. The low energy consumption is additionally due to the fact that the uniform compression results in a minimal working and breaking-up of the handled bulk material, which is also of great advantage in many cases, for example when dewatering cellulose fibres, where a shortening of the length of the fibres can result in the paper in which the fibres are incorporated being of inferior strength.

The conical screw compressor according to the invention also comprises means for rotating the screw in a housing which surrounds the screw, an inlet opening for the bulk material which is to be compressed and/or from which liquid is to be removed, an outlet opening for this bulk material, and, where appropriate, at least one outlet opening for the liquid which has been extracted. In one embodiment of the invention, the outlet opening for the extracted liquid is situated close to the inlet opening for bulk material, in which case the extracted liquid is forced in countercurrent to the bulk material in the screw compressor.

The shell of the conical portion of the screw housing which surrounds the screw can be designed in different ways, two of which are, on the one hand, to prevent rotation of the bulk material in the screw, and, on the other hand, to form channels in which liquid can be led away. In one embodiment of the invention, the housing is made up of segments which are longitudinal and which narrow in the direction of transport, which segments partially overlap one another in such a way that the next succeeding segment, as seen from the inside in the direction of rotation of the screw, lies partially over the next preceding segment and thus forms longitudinal edges in the direction of transport of the bulk material. Other embodiments are also conceivable, where the housing is cast with flutes or is machine-finished. Likewise, spiral-shaped, non-axial grooves can also be present.

The outlet opening for compressed bulk material according to the invention is designed with a means of resistance against the bulk material, comprising a resistance member rotating with the screw in a seat connected securely to the screw housing. The resistance member is secured on the screw shank by means of, for example, a wedge or spline connection and, for the purpose of adjusting the compression pressure, can be moved axially along the screw shank. The resistance member is expediently arranged with a resilient element which can take up transient variations in the size distribution and composition of the bulk material. The resistance member and corresponding seat can have different designs depending on what function is desired and can, for example, be formed as a truncated cone in a likewise conical seat, in which case an annular outlet gap is formed. According to one embodiment, the angle of the resistance member cone and the angle of the outlet cone (the seat) are chosen such that the cross-sectional area of the annular gap continuously decreases towards the bulk material outlet, which fact further increases the removal of liquid and the compression. However, both the resistance member and the seat, either individually or jointly, can have parts with other angles, such that there is, for example, in the first portion, a constriction effect as a result of the decreasing cross-sectional area where the material is compress, and, in the later portion, an increasing cross-sectional area, which gives a bursting effect, which results in the material being obtained in compressed, manageable pieces.

In the case of removal of liquid, a decreasing area of the annular gap guarantees a tight ring of material so that the liquid is forced in countercurrent to the material towards the liquid outlet, situated close to the screw inlet. The rotational movement of the resistance member, and the friction with respect to the material which is stationary in terms of rotation in the screw outlet, shape the material into an even tighter ring, the sealing being so effective that no liquid is allowed through into the outlet. In the case of removal of liquid, the resistance member cone is preferably designed with a smooth surface.

If the bulk material is wanted in a finely divided form, both the outer cone and inner cone, or one of them, can be provided with configurations in order to give a milling effect.

A further advantage of the resistance member according to the invention is that the resistance member at the same time constitutes a bearing for the screw at the bulk material outlet end, while the other end can be provided with a spherical bearing, for example. This affords a less expensive and simpler solution than a screw construction in which the screw is mounted at both ends. When the bulk material is pressed out in the gap between resistance member and seat, an axial force develops in the screw shank, in the direction counter to that which develops in the screw during transport of material. This means that the bearing load on the second bearing is reduced and the bearing can be made smaller. The reduction of the bearing load can amount to about 30%.

The co-rotating movement also facilitates the discharge of the material, which on the one hand reduces the power requirements and on the other hand reduces the counter-pressure in the screw, which in turn means that greater counter-pressure is allowed before the material begins to rotate with the screw in the casing. The design of the resistance member with a resilient element essentially guarantees the same counter-pressure in the event of variations in the bulk material flow and/or the piece size and additionally permits individual, larger particles to pass, which fact prevents jamming of the screw.

Further characteristics and aspects as well as advantages of the invention are evident from the attached patent claims and from the following description of two possible embodiments.

DETAILED DESCRIPTION OF TWO EMBODIMENTS OF THE INVENTION

Figure 1:
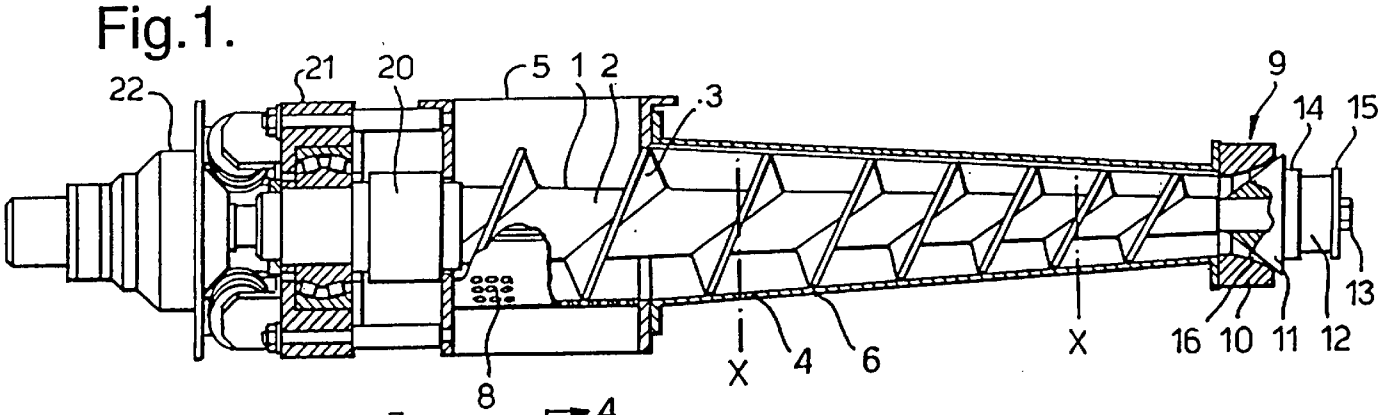
FIG. 1 shows a side view, in cross-section, of a conical screw press according to the invention.
Figure 2:
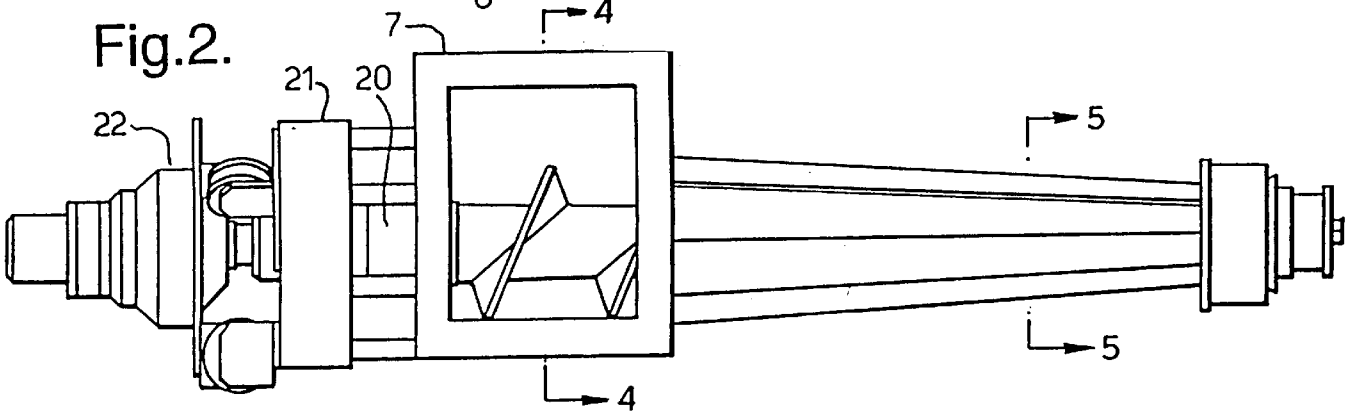
FIG. 2 shows a view of a conical screw press according to the invention, seen from above.
Figure 5:
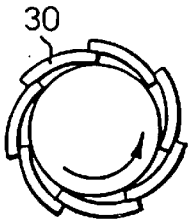
FIG. 5 shows a cross-section 5—5 of an embodiment of the conical portion of the housing which surrounds the screw.
Figure 4:
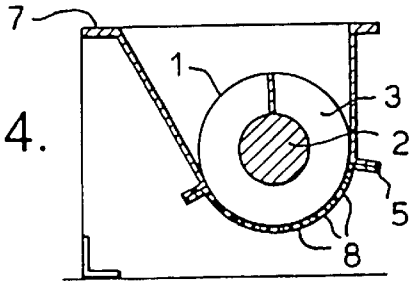
FIG. 4 shows a cross-section 4—4 through the feed portion of a conical screw press according to the invention.

With reference to FIGS. 1–6, the conical screw press comprises a screw 1 consisting of a core 2 with screw threads 3. The screw is arranged to rotate in a housing 4 which comprises an inlet portion 5 for the bulk material to be pressed and which is also the outlet portion for the pressed-out liquid, and a conical portion 6. The portion 5 is provided with a rectangular inlet opening 7 for bulk material and outlet holes 8 for pressed-out liquid. In the conical portion 6 of the housing 4, at the outlet end for bulk material, there is an outlet portion 9 comprising an outlet opening 10 connected firmly to the housing 4, a conical element 11 connected to the screw core 2 and arranged such that it can be adjusted in the axial direction but rotates with the screw 1, a resilient element 12 consisting of polyurethane, a screw 13 screwed into the core 2 of the screw 1, and washers 14 and 15. The outlet opening 10 for bulk material and the conical element 11 together form, in the direction of transport of the bulk material, an annular outlet opening 16 of decreasing cross-sectional area for the pressed bulk material. At the inlet end 7 for bulk material there is a sealing arrangement 20, a bearing housing 21 and a hydraulic motor 22. The conical portion 6 of the housing 4 is made up of five segments 30 which are longitudinal and which narrow in the direction of port, which segments partially overlap one another in such a way that the next succeeding segment, as seen from the inside in the direction of rotation of the screw, lies partially over the next preceding segment and thus forms longitudinal edges in the direction of transport of the bulk material (FIG. 5).

The screw of the conical screw press is dimensioned, within at least the greater portion of the length of the screw between the inlet opening for bulk material and the outlet opening for bulk material, such that the external diameter (D) of the screw thread and the diameter (d) of the screw core change axially in the screw press from a first arbitrary axial position, where the external diameter of the screw thread=$D_1$ and the diameter of the screw core=$d_1$, to an arbitrary second axial position, situated downstream in the direction of the bulk material, where the external diameter of the screw thread=$D_2$ and the diameter of the screw core=$d_2$, in accordance with the formulae:

$$D_2 = \frac{D_1}{\sqrt[3]{K}} \qquad d_2 = \frac{d_1}{\sqrt[3]{K}}$$

where K is a compression ratio, i.e. the volume of the bulk material at the first position in relation to the volume of the bulk material at the second position.

The angle $\alpha$ of the screw threads (FIG. 3) is essentially constant within the said portion of the length of the screw.

The width b of the screw crests and the thread root diameter R also vary in accordance with the formulae:

$$b_2 = \frac{b_1}{\sqrt[3]{K}} \qquad R_2 = \frac{R_1}{\sqrt[3]{K}}$$

Figure 3:
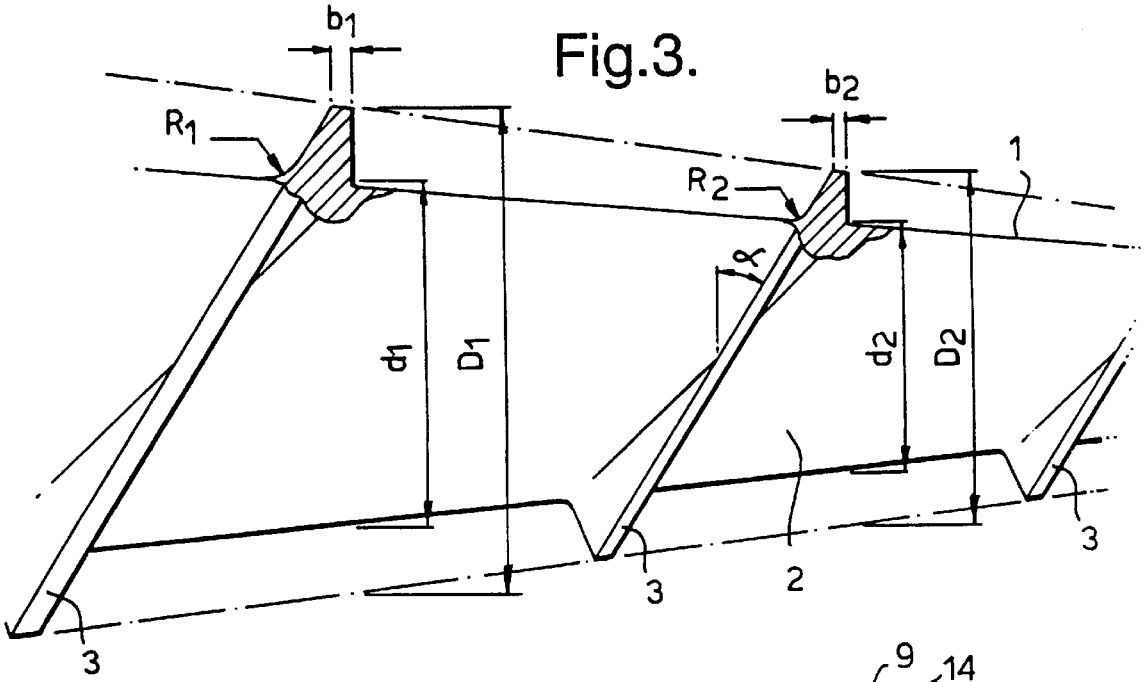
FIG. 3 shows a detail of a conical screw according to the invention.
Figure 6:
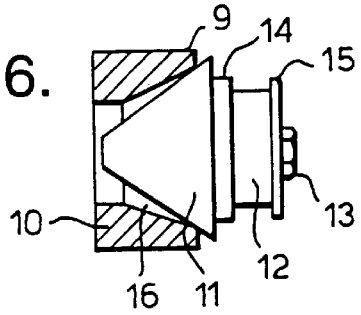
FIG. 6 represents a detail of an embodiment of the outlet opening for compressed bulk material.

According to FIG. 3, the screw threads meet essentially at right angles to the screw core in that part which faces the outlet for the bulk material.

The internal diameter of the screw housing changes with essentially the same ratio as the external diameter D of the screw thread, as above. The internal circumference of the screw housing, measured as the part lying nearest the external diameter of the screw threads, is in this case at a distance of 1–2 mm from the external diameter D of the screw threads.

The screw press operates such that the bulk material which is to be pressed is supplied continuously through the rectangular inlet opening 7. A hydraulic motor 22 rotates the screw 1, the bulk material being transported by the screw through the housing 4 with linear, uniform, continuous compression. The design of the housing 4, with longitudinal segments 30 which form projecting edges inside the housing in the direction of transport of the bulk material, means, on the one hand, that rotation of the bulk material in the screw compressor is made more difficult, while at the same time the space in front of these edges, as seen in the direction of rotation of the screw, constitutes channels in which pressed-out liquid is transported when the screw is being used for removing liquid. The pressed bulk material then leaves the screw compressor through the narrowing, annular outlet opening 16, where the bulk material is compressed still further.

When removing liquid, the liquid which is pressed out of the bulk material runs in countercurrent to the bulk material, preferably in those channels between the bulk material and the housing 4 which are formed by the longitudinal segments 30, after which the liquid runs off through the holes 8 in the bottom of the bulk material inlet portion 5 of the housing.

Illustrative embodiment 1

Figure 7A:
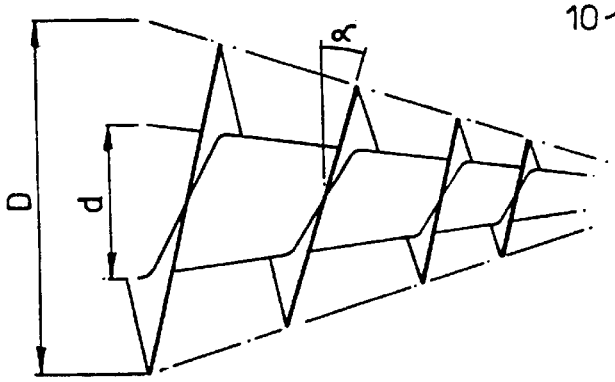
FIGS. 7*a* and 7*b* are illustrative embodiments of screw presses according to the present invention.

FIG. 7*a* is a diagrammatic representation of the screw of a screw press according to the invention, where the screw is dimensioned for compressing light, fluffy material. The compression across the screw is great in this case, with K chosen to be 10. The difference between D and d is great, and the ratio D:d is chosen to be 2.0. The pitch angle $\alpha$ is relatively small at about 12°.

Illustrative embodiment 2

Figure 7B:
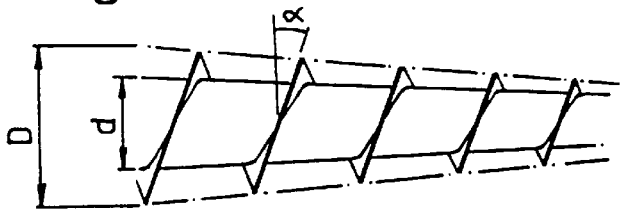

FIG. 7*b* is a diagrammatic representation of the screw in a screw press according to the invention, where the screw is dimensioned for removing liquid from sediment from a cellulose industry. The compression across the screw is small, with K chosen to be 4. The difference between D and d is small, and the ratio D:d is chosen to be 1.2 The pitch angle $\alpha$ is 25°.

Tests have shown that bark which has been pressed in a conventional bark press and has thereafter been dried with warm air in a silo to a dry matter content of 35% has, after compression in the screw press according to the invention, achieved a dry matter content of 50%. The thermal value has in this way been increased from 1.4 MWh/ton to 2.4 MWh/ton.

In another test, 25% sediment from a paper mill was mixed with bark. The sediment had a dry matter content of 18% and was unusable as fuel. In the absence of economical methods for increasing the dry matter content, the sediment was normally discarded. The bark had a dry matter content of 25%. However, compression and dewatering in the screw compressor according to the invention was able to increase the dry matter content to 50%. The thermal value of the mixture was increased in this way from 0.7 MWh/ton to 2.4 MWh/ton.

In both examples, the capacity was 2.2 tons/hour and the power consumption 10 kW.

I claim:

1. A conical screw press for compressing and removing liquid from bulk material, comprising a screw with a screw thread and a core in a housing, means for rotating the screw in the housing, an inlet opening for the bulk material from which liquid is to be removed located in the housing, an outlet opening for the bulk material from which liquid has been removed located in the housing, and at least one outlet opening for the liquid which has been extracted located in the housing, characterized in that:

a) the screw is dimensioned, for at least the greater portion of the length of the screw between the inlet opening for bulk material and the outlet opening for bulk material, such that the external diameter (D) of the screw thread and the diameter (d) of the screw core change axially in the screw press from a first axial position, where the external diameter of the screw thread=$D_1$ and the diameter of the screw core=$d_1$, to a second axial position, situated downstream in the direction of the bulk material, where the external diameter of the screw thread=$D_2$ and the diameter of the screw core=$d_2$, in accordance with the formulae:

$$D_2 = \frac{D_1}{\sqrt[n]{K}} \qquad d_2 = \frac{d_1}{\sqrt[n]{K}}$$

where K is a compression ratio, describing the volume of the bulk material at the first position in relation to the volume of the bulk material at the second position, and n is a number between 2.5 and 3.5;

b) the angle of the screw threads in relation to a plane at right angles to the core varies by at most 20% in either direction from a constant angle in relation to said plane within said portion of the length of the screw.

2. The conical screw press according to claim 1, characterized in that n is a number between 2.7 and 3.3.

3. The conical screw press according to claim 2, characterized in that n is a number between 2.9 and 3.1.

4. The conical screw press according to claim 3, characterized in that n is 3.

5. The conical screw press according to claim 1, characterized in that the angle of the screw thread varies by at most 10% in either direction from a constant angle in relation to the plane.

6. The conical screw press according to claim 5, characterized in that the angle of the screw thread in relation to the plane is constant.

7. The conical screw press according to claim 5, characterized in that the angle of the screw thread varies by at most 5% in either direction from a constant angle in relation to the plane.

8. The conical screw press according to claim 1, characterized in that the screw is mounted on bearings only at the end nearest the bulk material inlet end.

9. The conical screw press according to claim 1, characterized in that a portion of the housing is conical and comprises longitudinal segments narrowing in the direction of transport, which segments partially overlap one another in such a way that the next succeeding segment, as seen from the inside in the direction of rotation of the screw, lies partially over the next preceding segment and thus forms longitudinal, projecting edges in the direction of transport of the bulk material.

10. The conical screw press according to claim 1, characterized in that a portion of the housing is conical and the outlet opening for liquid is arranged in the bottom of a feed portion of the housing, before the start of the conical portion of the housing.

11. The conical screw press according to claim 1, characterized in that the compression ratio K is between 7 and 15.

12. The conical screw press according to claim 11, characterized in that the compression ratio K is between 8 and 12.

13. The conical screw press according to claim 1, characterized in that the compression ratio K is between 2 and 6.

14. The conical screw press according to claim 13, characterized in that the compression ratio K is between 3 and 5.

15. The conical screw press according to claim 1, characterized in that the ratio D:d between the external diameter of the screw thread and the diameter of the screw core is at least 1.5 and at most 2.5, and at the same time the pitch angle of the threads is at least 10° and at most 25°.

16. The conical screw press according to claim 1, characterized in that the ratio D:d between the external diameter of the screw thread and the diameter of the screw core is at least 1.2 and at most 1.5, and at the same time the pitch angle is at least 20° and at most 30°.

17. The conical screw press according to claim 1, said conical screw press having an outlet portion for bulk material, characterized in that the outlet portion comprises a bulk material outlet opening which is firmly connected to the screw housing and which constitutes a seat for an element, the element is connected to the screw core and arranged such that the element can be displaced in the axial direction and can rotate with the screw and is provided with a resilient element.

18. The conical screw press according to claim 17, characterized in that both the inside of the outlet opening constituting a seat for the element and the element have the form of truncated cones.

19. The conical screw press according to claim 17, characterized in that an annular gap between the outlet opening and the element has a cross-sectional area which decreases in the direction of transport of the bulk material.

* * * * *